United States Patent [19]

Cheng

[11] Patent Number: 5,039,244

[45] Date of Patent: Aug. 13, 1991

[54] TOOTHBRUSH AND TOOTHPASTE SYSTEM

[76] Inventor: Shuchao Cheng, 5305 Canyon Crest Dr., San Ramon, Calif. 94583

[21] Appl. No.: 493,468

[22] Filed: Mar. 14, 1990

[51] Int. Cl.[5] ..... A46B 11/02

[52] U.S. Cl. ..... 401/176; 401/179; 401/278; 401/279

[58] Field of Search ..... 401/171, 176, 179, 180, 401/181, 278, 279, 66

[56] References Cited

U.S. PATENT DOCUMENTS

| | | | |
|---|---|---|---|
| 677,667 | 7/1901 | Kirschen | 401/179 X |
| 841,946 | 1/1907 | Downing | 401/278 |
| 1,212,010 | 1/1917 | Brown | 401/278 X |
| 1,590,547 | 6/1926 | Prusso . | |
| 1,742,157 | 12/1929 | Christian | 401/176 X |
| 2,033,197 | 3/1936 | Kinkade . | |
| 2,243,774 | 5/1941 | Resh . | |
| 2,274,790 | 3/1942 | Housley . | |
| 2,278,253 | 3/1942 | Ellsworth . | |
| 4,062,635 | 12/1977 | Teh-Sheng . | |
| 4,149,552 | 4/1979 | Stewmon . | |
| 4,467,822 | 8/1984 | Blackwell . | |
| 4,622,984 | 11/1986 | Gaebel . | |
| 4,655,627 | 4/1987 | Bradley . | |
| 4,733,983 | 3/1988 | Hertrampf . | |

FOREIGN PATENT DOCUMENTS

| | | | |
|---|---|---|---|
| 242548 | 1/1912 | Fed. Rep. of Germany | 401/66 |
| 278718 | 10/1914 | Fed. Rep. of Germany | 401/176 |
| 2383711 | 11/1978 | France | 401/278 |
| 2623699 | 6/1989 | France | 401/279 |

*Primary Examiner*—Steven A. Bratlie

*Attorney, Agent, or Firm*—Bielen, Peterson & Lampe

[57] ABSTRACT

A toothbrush and toothpaste system utilizing a container for the toothpaste which includes a chamber having a movable piston within the same. A spline is generally centrally located within the chamber with the movable piston circumjacently located relative to the spline. The piston is intended to contact toothpaste which is loaded within the chamber. The pistons movement is biased in one direction along the line. A head is connected to the container and includes a bristle structure usable as a toothbrush. The head includes a passageway which communicates with the adjacent chamber of the container and the bristle structure of the head. A valve separated by movement of the spline opens the passageway permitting communication between the chamber and the bristle structure. Springs means is also included for closing the valve relative to the container. The piston continually moves along the spline during the delivery of toothpaste to the bristle structure in only one direction within the chamber of the container.

10 Claims, 4 Drawing Sheets

TOOTHBRUSH AND TOOTHPASTE SYSTEM

BACKGROUND OF THE INVENTION

The present invention relates to a novel toothbrush and toothpaste system.

It is commonly known that a separate toothbrush and toothpaste tube is necessary to accomplish the task of brushing one's teeth.

There have been many prior devices which have attempted to accommodate separate toothbrushes and toothpaste tubes by combining the same into one element. For example, U.S. Pat. Nos. 1,590,549; 4,062,635; 4,149,552; 4,467,822; 4,622,984; and 4,655,627 describe toothbrush and toothbrush arrangements which employ a threaded rod which is rotated to move a threaded piston within the toothpaste holding chamber.

U.S. Pat. No. 2,278,253 and 2,274,790 describes a container and brush dispensing devices which employ a plunger and check valve combination. U.S. Pat. Nos. 2,033,197 and 4,733,983 employ a vacuum or fountain pen type arrangement to dispense toothpaste from a container connected to a toothbrush.

Finally, U.S. Pat. No. 2,243,774 describes a free moving piston which is ratchet along a ratchet to dispense toothpaste to a toothbrush without the benefit of a valving arrangement.

A toothbrush and toothpaste system which accurately and efficiently dispenses toothpaste to a toothbrush head would a notable advance in the personal hygiene field.

SUMMARY OF THE INVENTION

In accordance with the present invention, a novel and useful toothbrush and toothpaste system is herein provided.

The system of the present invention utilizes a container for toothpaste having a chamber with a centrally located spline within the chamber. The chamber may be provided by a removable cartridge. A piston is movable within the chamber along the spline and generally lies circumjacent relative to the spline. The piston includes means for contacting the spline to bias its movement in one direction. A push plate is connected to the spline at one of the chamber in order to effect such movement of the spline within the chamber. The piston may include two sets of feet which extend to and engage the spline which may be constructed with a series of grooves. The grooves are defined to lie along the direction of movement of the spline within the chamber of the container. Feet extending from the piston may be of two types, one type which engages the trough of each of the grooves and another type which engages the sides of the grooves of the spline. The feet may extend at an angle from the piston to bias movement along the spline in one direction.

The system of the present invention may also be constructed with a head which may be removably connected to the container. The head includes a bristle structure having a passageway which communicates with the chamber of the container and the bristle structure of the head.

Valve means is also included in the present invention for opening and closing the passageway in the head portion of the system. Thus, such opening and closing of the passageway also permits toothpaste to flow from the chamber of the container to the bristle structure of the head or to block the same as the case may be. The valve means actuates with the movement of the spline and is linked thereto. Spring means closes the valve means relative to the container after movement of the spline in one direction. Valve means may include a shaft linked to the spline for movement with the spline. The shaft may also be formed with enlargement which is movable within the passageway of the head. The enlargement is capable of selectively blocking or permitting passage of toothpaste from the container through the passageway of the head.

Spring means is also included for closing the valve means relative to the chamber of the container after release of the push-plate by the user.

Another aspect of the present invention is to provide for a novel bristle structure which includes a plurality of first rows of bristles extending a first length from the toothbrush head. A plurality of second rows of bristles extend a second length from the toothbrush head. Each of the first rows of bristles are substantially parallel and alternatively arranged relative to each of the second rows of bristles.

In addition, another bristle structure may be defined in the present invention to include a plurality of first rows of bristles extending from the toothbrush head having an end surface which is mitred in one direction. The second plurality of rows of bristles extend from the toothbrush head and each row includes end surface which is mitred in another direction relative to each of the first rows of bristles. Again, the first and second rows of bristles alternate and lie parallel to one another on the head of the toothbrush.

It may be apparent that a novel and useful toothbrush and toothpaste system is herein described.

It is therefore an object of the present invention to provide a toothbrush and toothpaste system which utilizes a container and a bristle structure on a toothbrush head which may be operated by push button means that includes a valve arrangement which is directly linked to movement of a spline within the container holding the toothpaste.

Another object of the present invention is to provide a toothbrush and toothpaste system which includes a cartridge containing toothpaste which is replaceable relative to the toothbrush head.

Yet another object of the present invention is to provide a toothbrush and toothpaste system which is extremely reliable and may be easily cleaned should clogging occur within the system.

A further object of the present invention is to provide a bristle structure for a toothbrush head which possesses a novel configuration which is most useful in cleaning of teeth.

A further object of the present invention is to provide a toothbrush and toothpaste system which may be easily molded and, thus, easily constructed for use.

The invention possesses other objects and advantages especially as concerns particular characteristics and features thereof which will become apparent as the specification continues.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which may be taken in conjunction with the prior described drawings.

Figure 1A:
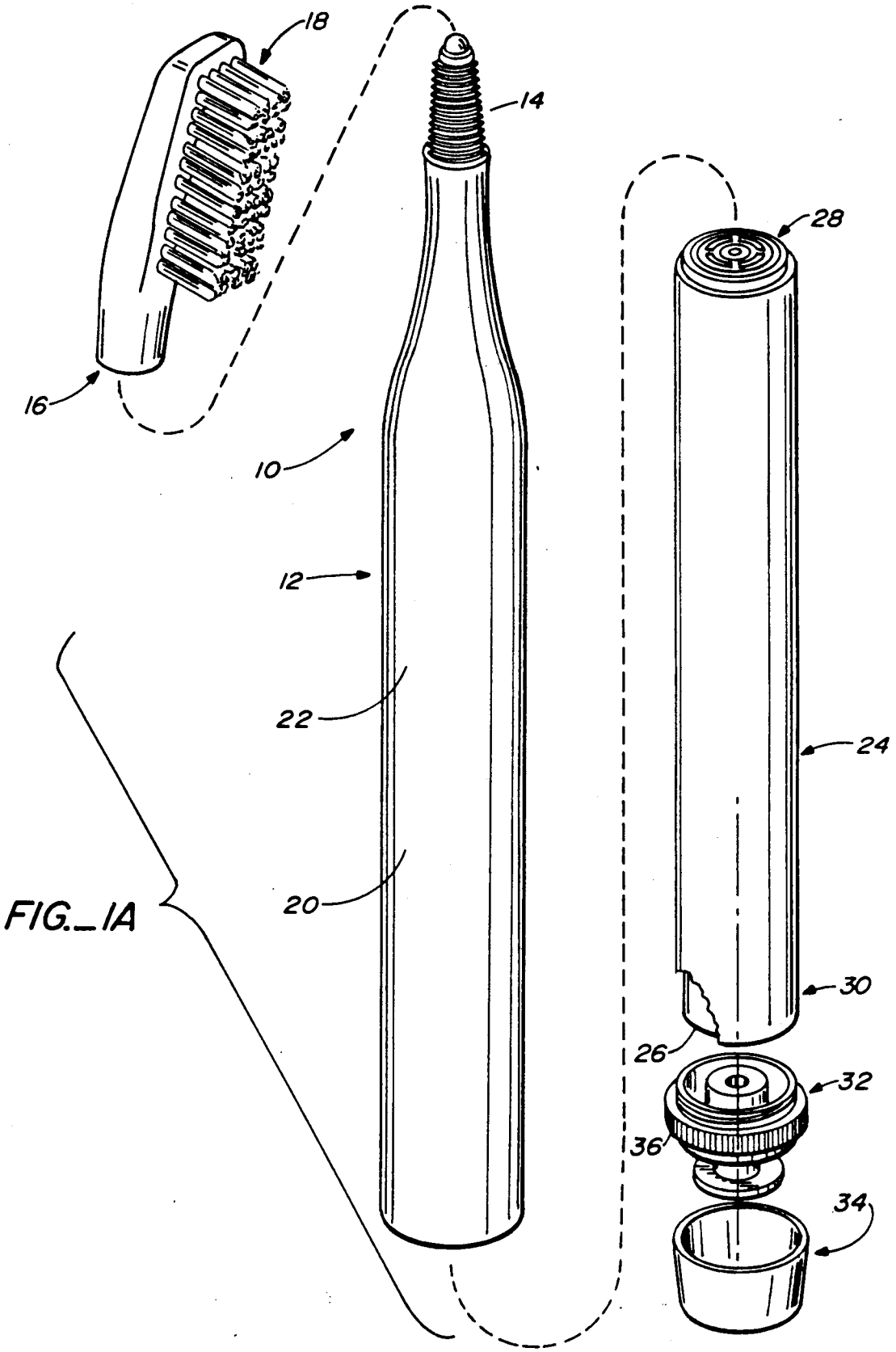
FIG 1A is an exploded view of the system of the present invention.

The invention as a whole is shown in the drawings by reference character 10. The toothbrush and toothpaste system 10 includes as one of its elements container 12, FIG. 1A being a threaded end portion 14. Head 16 possesses an internally threaded portion, FIG. 2, which threadingly engages threaded end portion 14 of container 12.

Container 12 possesses an outer housing 20 with a gripping surface 22 for the user of system 10. Container 12 further possesses a cartridge 24 which is removable from housing 20. Cartridge 24 includes a chamber 26 which is loaded with toothpaste. End portions 28 and 30 generally mark the bounds of cartridge 24. Pusher mechanism 32 and the cap 34 enclose cartridge 24 within housing 22. Pusher mechanism 32 includes a knurled outer surface 36 to aid in the gripping of container 12. Container 12 and cartridge 24 may be constructed of plastic materials such as polycarbonate, nylon, polypropylene, polyester, and the like. Bristle structure 18 may be composed of polyester, nylon and like materials. In addition, container 12 and cartridge 24 may be formed as a transparent member in order to instantly provide the user with a visual gage of the amount of toothpaste or dentifrice found within cartridge 24.

Figure 2:
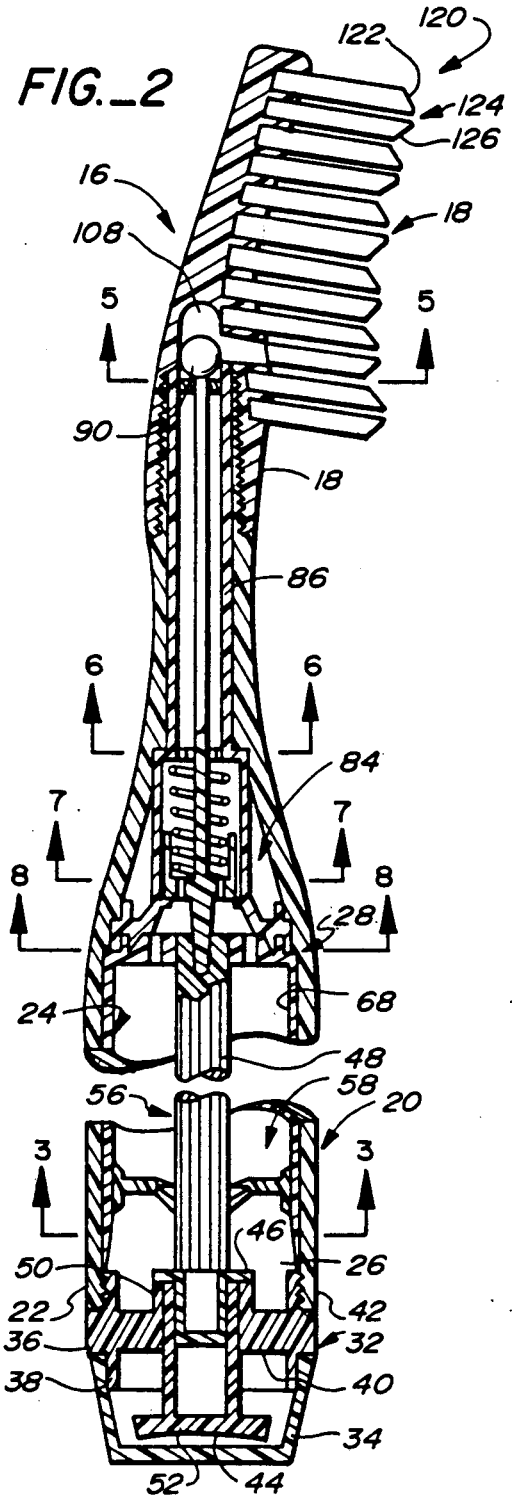
FIG. 2 is a sectional view one embodiment of the present invention which is depicted in FIGS. 1 and 1A.

Turning to FIG. 2, it may be observed that cap 34 press fits to a shoulder 38 of guide 40. Guide 40 threadingly engages housing 20 at threaded portion 42 therebetween. Pusher member 44 surrounds a bushing 46 which captures spline 48. Thus, pusher member 44 is movable relative to the inner surface 50 of guide 40. It should be noted that cap 34 is removable to allow access to pusher member 44, in particular plate 52.

Figure 2A:
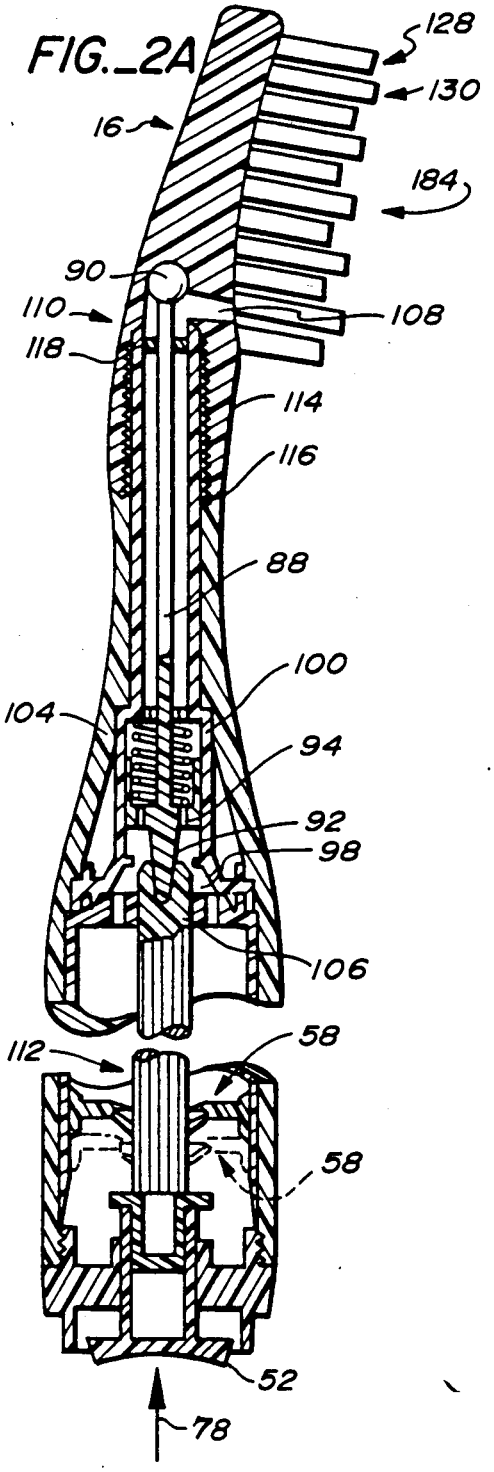
FIG. 2A is a sectional view of the embodiment shown in FIGS. 1 and 1A with the system in the open position.
Figure 2B:
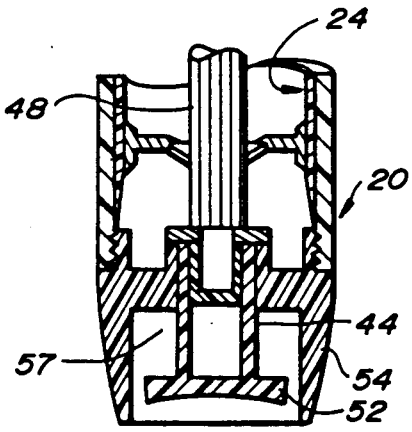
FIG. 2B is a partial sectional view showing another embodiment of the present invention.

Turning to FIG. 2B, it may be seen that another embodiment is depicted where guide 54 is depicted having a cavity 56 to at least partially encompass pusher member 44. The structure depicted in FIG. 2B eliminates the need for a cap, such as cap 34 shown in FIG. 2A.

Figure 1:
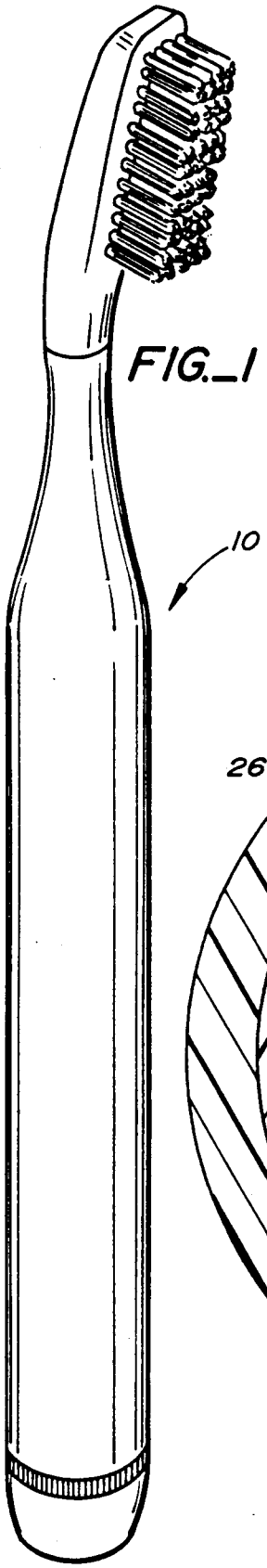
FIG. 1 is a top, left side, perspective view of the system of the present invention.
Figure 4:
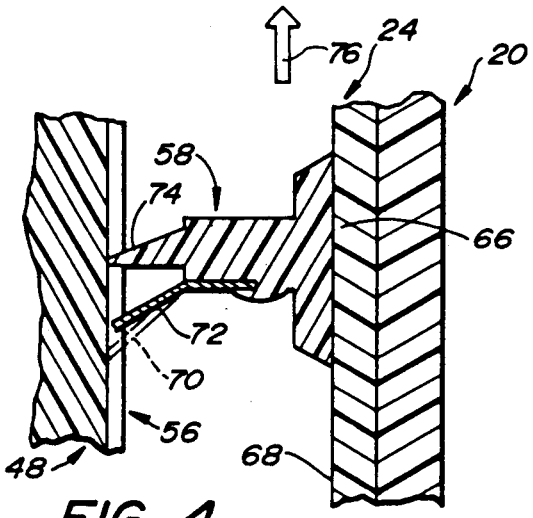
FIG. 4 is a sectional view taken line 4—4 of FIG. 3.
Figure 3:
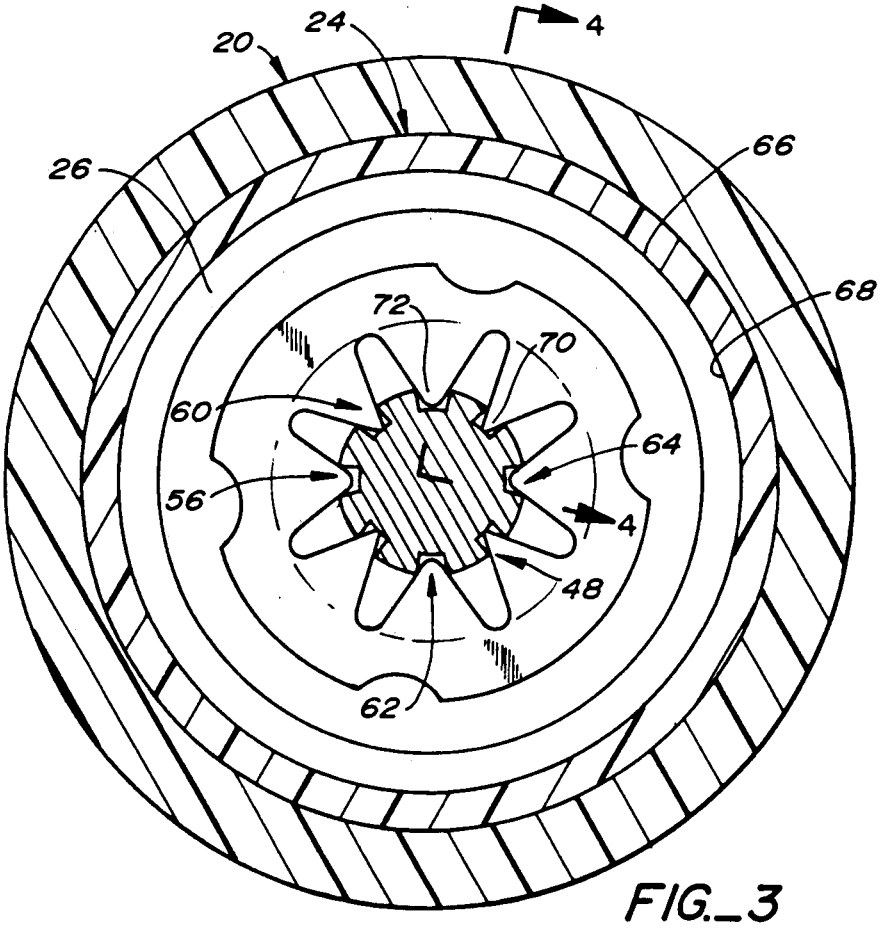
FIG. 3 is a sectional view taken along line 3—3 of FIG. 2.

Spline 48 extends essentially axially relative to chamber 26 of container 12. A series of grooves 56 along spline 48 also extends in the axial direction of chamber 26. Piston 58 lies circumjacently relative to spline 48. With reference to FIG. 3 it should be seen that piston 58 includes a first plurality of feet 60 extending to and engaging the trough 62 of grooves 56 found on spline 48. The second set of feet 64 frictionally engage the sides grooves 56. The periphery 66 of piston 58 slidingly and sealingly engages the inner surface 68 of cartridge 24. FIG. 4 reveals that typical feet 70 and 72 of sets of feet 60 and 64, are respectively, depicted as engaging grooves 56 on spline 48. Foot 70 engages the base or floor of one of the plurality of grooves 56, while foot 72 engages the walls of another of the plurality of grooves 56. Second set of feet 64 of piston 58 do not angle outwardly as far as first set of feet 60 of piston 58. Also, a seal member 74 extends from piston 58 to prevent dentifrice from passing through grooves 56 from one side of piston 58 to the other side of piston 58. In essence, first and second sets of feet 60 and 64 bias the movement of piston 58 upwardly, along directional arrow 76, FIG. 4. Such movement is shown in FIG. 2A by the phantom rendition of piston 58 when plate 52 is pushed along directional arrow 78.

Figure 8:
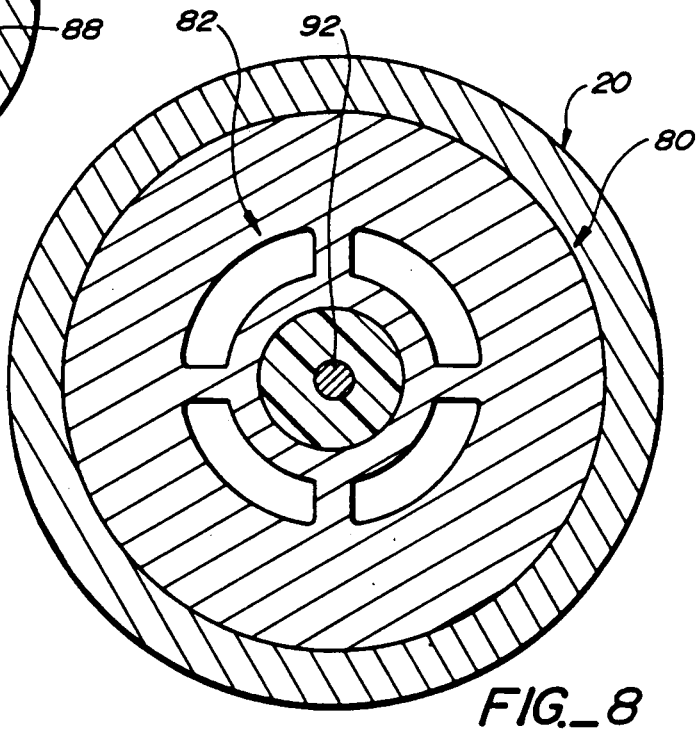
FIG. 8 is a sectional view taken along line 8—8 of FIG. 2.

Spline 48 which may constructed of any non-corrosive metallic or plastic materials, extends generally axially along chamber 26 to end 28 of cartridge 24. A guide 80 is formed at end portion 28 of cartridge 24, FIG. 8, and includes a multiplicity of openings 82 to permit dentifrice to travel from chamber 26 of cartridge 24 to bristle structure 18.

Figure 7:
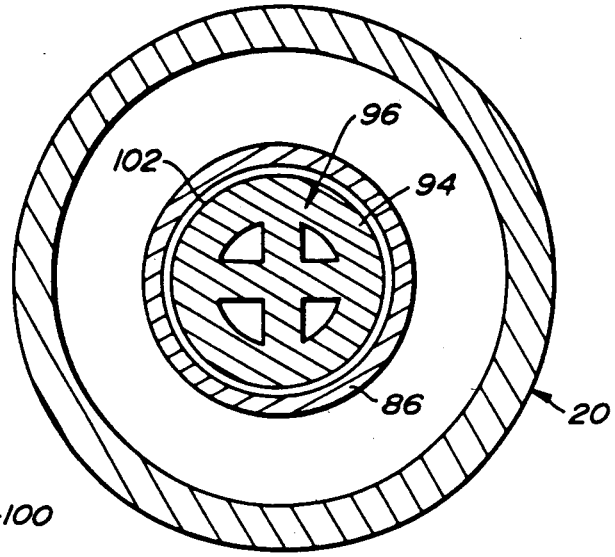
FIG. 7 is a sectional view taken along line 7—7 of FIG. 2.
Figure 6:
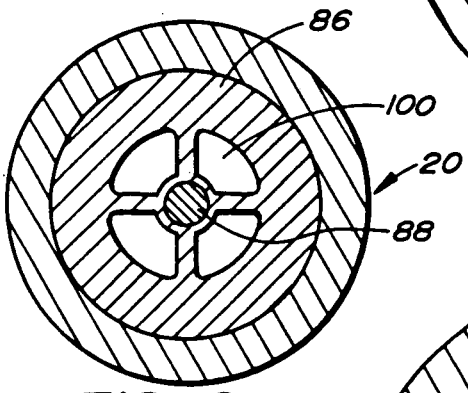
FIG. 6 is a sectional view taken along line 6—6 of FIG. 2.

Injection nozzle assembly 84, possesses a shell 86 which encloses a shaft 88 having an enlargement or ball 90 on one end and a tip 92 on the other end. Shoulder 94 of shaft 88 includes a multiplicity of openings 96 which permit the passage of dentifrice from hollow 98 to enclosure 100 of shell 86, FIG. 2A and FIG. 7. Lubricating member 102, such as teflon and the like, permit shoulder 94 to easily slip along the inner surface of shell 86 within enclosure 100. Spring member 104 biases shaft 88 and spline 48 toward pusher plate 52. Spring member 104 lies within enclosure 100 of shell 86. It should be apparent that tip 92 of shaft 88 lies within end portion 106 of spline 48 to effect this movement.

Turning again to FIG. 2, head 16 includes a passageway 108 which permits communication of the dentifrice traveling from chamber 26 through shell 86 to bristle structure 18. As depicted in FIG. 2, enlargement 90 is blocking such passage of dentifrice by seating in guide 118. On the other hand, FIG. 2A depicts the position of enlargement 90 such that dentifrice may travel through passageway 108 to bristle structure 18 or 18A. Thus, enlargement 90 of shaft 88 serves as valve means 110 for opening and closing passageway 108 during movement of pusher plate 52 and spline 48. It should be apparent that first and second sets of feet 60 and 64 also serve as means 112 for preventing movement of piston 58 back toward plate 52 when spring member 104 urges spline 48 to the position shown in FIG. 2.

Figure 5:
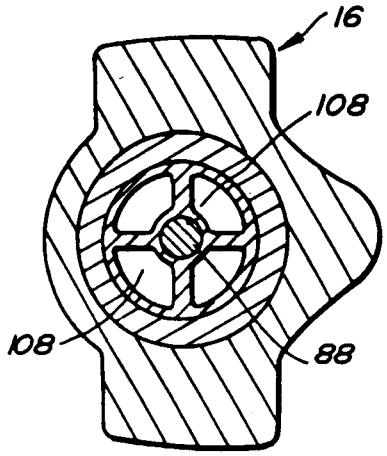
FIG. 5 is a sectional view taken along line 5—5 of FIG. 2.

Head 16 and housing 20 include threadingly engaging portions 114 which permit head 16 to be removed from housing 20 for cleaning or other purposes. Stop ring 116 holds head 16 to housing 20 when these elements are connected. Enlargement 90 and shaft guide 118 are not affected by removal of head 16, FIGS. 2 and 5.

With respect again to FIGS. 2 and 2A, bristle structures 18 and 18A are depicted. Bristle structure 18 includes a plurality of first rows of bristles 120 extending from toothbrush head 16 with mitred end surfaces 122 in one direction. A plurality of second rows of bristles 124 include end surfaces 126 which are mitred in a different direction.

Bristle structure 18A is formed by a plurality of first rows of bristles 128 which extend a first length from toothbrush head 16. A plurality of second rows of bristles 130 extend a second length from toothbrush head 16, in this case a further distance. First and second rows 128 and 130 are arranged substantially parallel to one another and in alternate configuration, similar to a plurality of rows 120 and 124 of bristle structure 18.

In operation, the user places cartridge 24, loaded with dentifrice within housing 20. Pusher mechanism 32 and cap 34 are placed in cartridge 24 within housing 20 as depicted in FIGS. 2 and 2A. The user then removes cap 34 or, in the case of the embodiment shown in FIG. 2B, places a finger within cavity 57 to engage plate 52. Plate 52 of pusher member 54 is then moved along directional arrow 78, FIG. 2A. Spline 48 and shaft 88 move toward bristle structure 18 and 18A, as the case may be, to open passageway 108. Piston 58 forces dentifrice through chamber 26, hollow 98, and the inside of shell 86 to passageway 108 and onto the exterior of head 16 at bristle structure 18 or 18*a*. Releasing pusher plate 52 causes spring member 104 to move tip 92 of shaft 88, spline 48, and pusher member 48 away from head 16. This movement also causes enlargement 92 to close the end of shell 86 to prevent further passage of dentifrice from chamber 26. Piston 58, however, remains at a place along the inner surface of cartridge 24 since means 112, due to the previously discussed interactions between sets of feet 60 and 64 and grooves 56 with spline 48, keep piston 58 from moving away from head 16 and toward pusher plate 52 when shaft 99 is forcing away from head 16 by spring member 104.

While in the foregoing embodiments of the invention have been set forth in considerable detail for the purposes of making a complete disclosure of the invention it may be apparent to those of skill in the art that numerous changes may be made in such details without departing from the spirit and the principles of the invention.

What is claimed is:

1. A toothbrush and toothpaste system comprising:

a. a container for toothpaste, said container including a chamber, a piston movable within said chamber, and a spline located along a dimension of said chamber, said spline including a series of substantially parallel grooves along said dimension of said chamber, said piston surrounding said spline and engaging said spline, said piston further contacting the toothpaste within said chamber;

b. means for biasing movement of said piston and said spline in one direction along said dimension of said chamber, piston biasing means including a pushplate linked to said spline;

c. a head connected to said container said head including a bristle structure and a passageway communicating with said chamber and said bristle structure;

d. valve means for opening said passageway in said had during movement in said one direction of said spline, said valve means being linked to said spline, said opening of said passageway permitting communication between said chamber and said bristle structure;

e. spring means for closing said valve means relative to said container by biasing movement of said spline in another direction along said dimension of said chamber piston; and f. means for preventing movement of said piston in said another direction, including said piston possessing a plurality of feet extending therefrom and being capable of engaging said grooves of said spline.

2. The system of claim 1 in which said plurality of piston feet include a first set of feet extending to and engaging the sides of said grooves and a second set of feet engaging the bases of said grooves.

3. The system of claim 2 in which said first set of feet extend from said piston at a different angle than said second set of feet.

4. The piston of claim 1 in which said head is threadingly attachable to and is detachable from said container.

5. The system of claim 1 in which said chamber is provided by cartridge removable relative to said container.

6. A toothbrush and toothpaste system comprising;

a. a container for toothpaste, said container including a chamber, a piston movable within said chamber and a spline located alone a dimension of said chamber, said piston surrounding said spline and engaging said spline, said piston contacting the toothpaste within said container, said spline including a series of substantially parallel grooves along said dimension of said chamber, b. means for biasing movement of said piston and said spline in one direction along said dimension of said chamber, biasing means including a plate linked to said spline;

c. a head connected to said container said head including a bristle structure, and a passageway communicating with said chamber and said bristle structure;

d. valve means for opening said passageway in said head during movement in said one direction of said piston, said valve means including a shaft linked to said spline for movement therewith, said shaft including an enlargement which is movable within the passageway of said head said enlargement being capable of selecting blocking communication between said passageway and said chamber, blocking communication between said passageway and said bristle structure, and clearing communicating between said chamber and said bristle structure.

7. The system of claim 6 which additionally comprises spring means for closing said valve means relative to said container.

8. The system of claim 7 in which said spline includes a series of substantially parallel grooves along said dimension of said chamber and said piston includes feet capable of engaging said grooves of said spline.

9. The system of claim 8 in which said piston feet include a first set of feet extending to and engaging the sides of said grooves and a second set of feet engaging the bases of said grooves.

10. The system of claim 9 in which said first set of feet extend from said piston at a different angle than said second set of feet.

* * * * *